United States Patent [19]

Peppel

[11] Patent Number: 4,759,662

[45] Date of Patent: Jul. 26, 1988

[54] TLP MARINE RISER TENSIONER

[75] Inventor: George W. Peppel, Arlington, Tex.

[73] Assignee: Lockheed Corporation, Calabasas, Calif.

[21] Appl. No.: 107,042

[22] Filed: Oct. 9, 1987

Related U.S. Application Data

[62] Division of Ser. No. 879,923, Jun. 30, 1986.

[51] Int. Cl.[4] ..... E02D 21/00

[52] U.S. Cl. ..... 405/195; 267/279; 166/367; 166/355; 405/224

[58] Field of Search ..... 405/195, 224, 203–209; 166/350, 359, 367, 368; 175/5, 7; 114/264, 265; 267/140.1, 279, 280, 281, 282

[56] References Cited

U.S. PATENT DOCUMENTS

| | | | |
|---|---|---|---|
| 2,158,028 | 5/1939 | Burke | 267/279 X |
| 2,783,822 | 3/1957 | Hickman et al. | 267/279 X |
| 2,873,110 | 2/1959 | Jonsson | 267/280 |
| 3,508,409 | 4/1970 | Cargile | 405/195 |
| 4,213,720 | 7/1980 | Portass | 405/195 |
| 4,362,438 | 12/1982 | Spink | 405/195 |
| 4,379,657 | 4/1983 | Widiner et al. | 405/303 X |
| 4,423,983 | 1/1984 | Dadiras et al. | 465/195 |

*Primary Examiner*—Dennis L. Taylor
*Attorney, Agent, or Firm*—Eric R. Katz

[57] ABSTRACT

Several embodiments of a marine riser tensioner (10, 100, 200, 300) are disclosed for use in tensioning a marine riser (12) on a tension leg platform (14) by the use of elastomeric elements. In one embodiment, a plurality of elastomeric pads (60) are placed in pad shear to provide tension to the marine riser. In another embodiment, elastomeric disks (124) are placed in torsional shear to provide the tension to the marine riser. In other embodiments (200, 300) elastomeric cones (208) deform in ring shear.

5 Claims, 4 Drawing Sheets

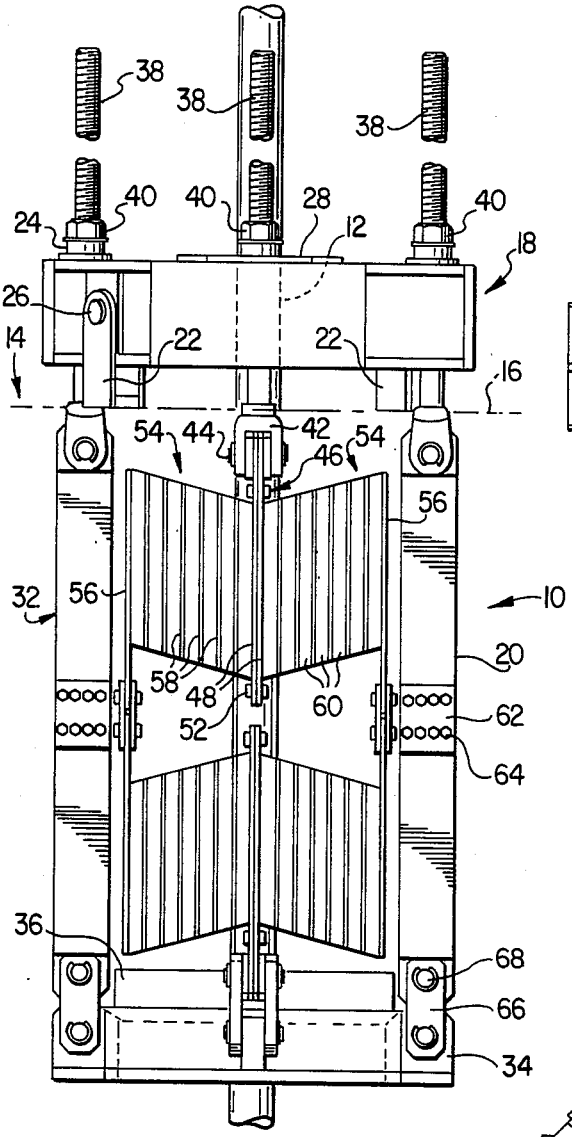
FIG. 2
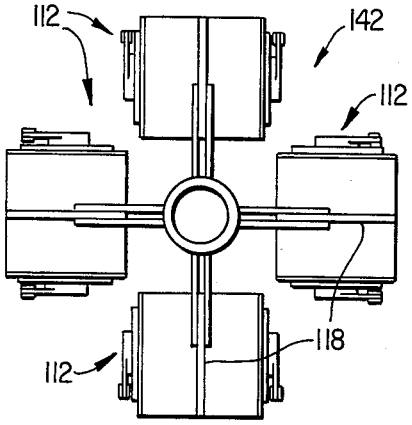
FIG. 5
FIG. 3
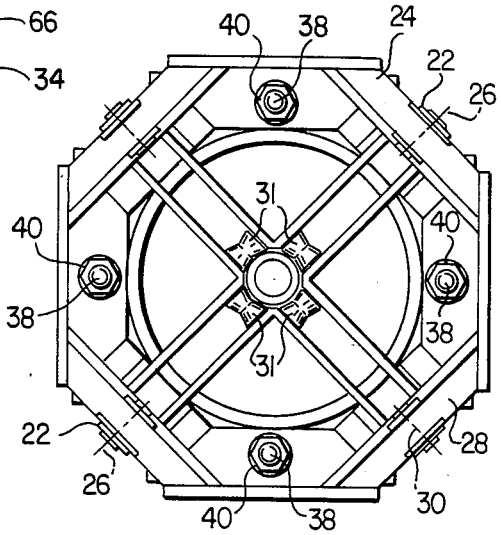

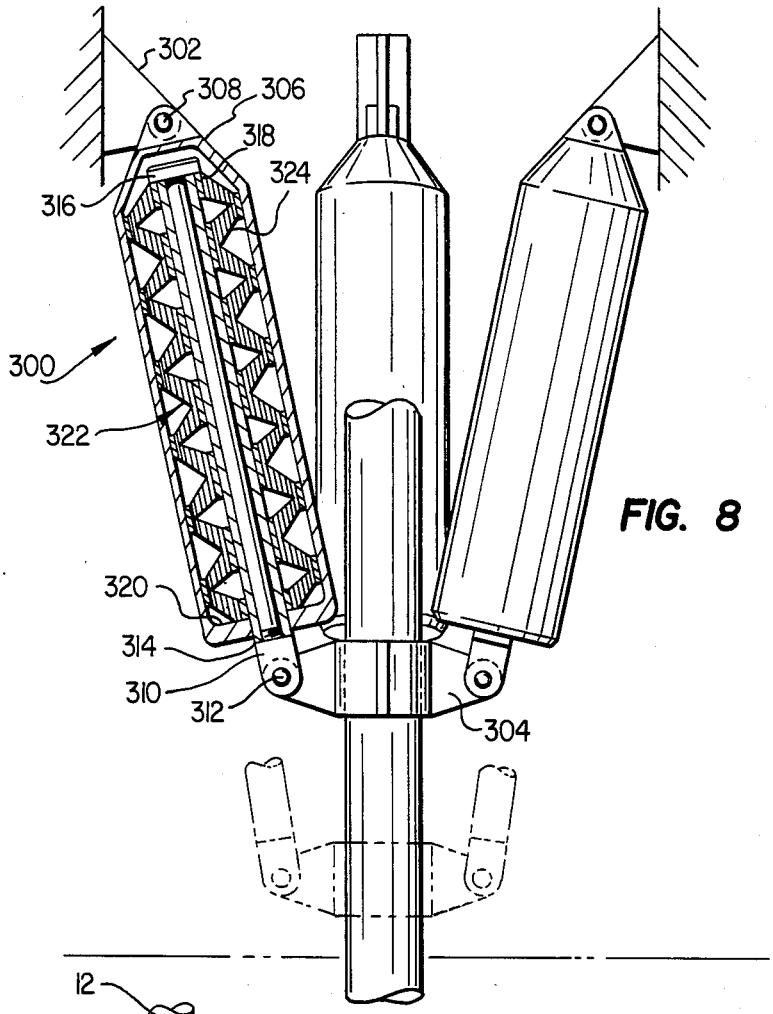
FIG. 8
FIG. 6
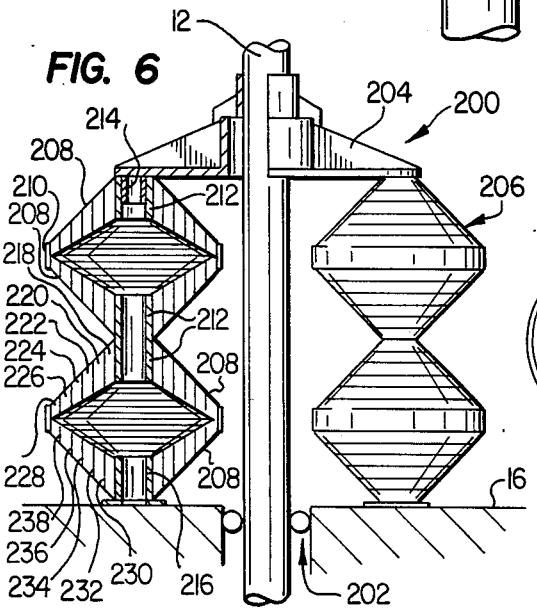
FIG. 7
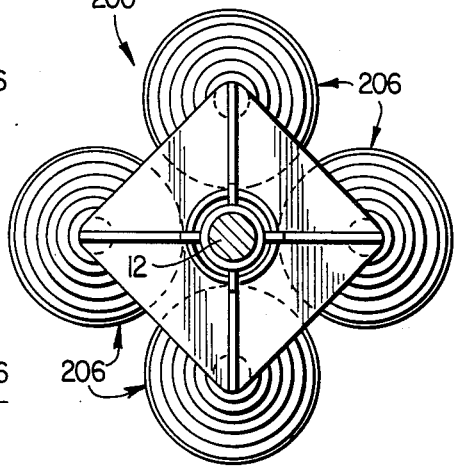

TLP MARINE RISER TENSIONER

This is a divisional of co-pending application Ser. No. 879,923 filed on June 30, 1986.

TECHNICAL FIELD

This invention relates to offshore oil drilling and production, and specifically to a marine riser tensioner for use in a tension leg platform.

BACKGROUND OF THE INVENTION

In recent years, a great effort has been exerted in exploring for and producing oil from oil fields under water. The Gulf of Mexico and the North Sea are specific examples where a great effort has been exerted.

Many techniques have been explored for efficient exploration and production of these undersea oil reserves. One recent development is the tension leg platform which can be used both for drilling and production. The tension leg platform (commonly referred to as TLP) is a floating structure, resembling a large semisubmersible drilling rig, connected to sea bed foundation templates by vertical mooring tethers. Buoyancy for the TLP is provided by watertight columns, pontoons and the like. The TLP is provided with an excess of buoyancy to keep the mooring tethers in tension for all weather and loading conditions.

Three separate marine riser systems are commonly used for conducting fluids between the subsea template and the TLP during both drilling and production phases. These riser systems are the drilling, production and crude oil sales risers. The risers are secured at the sea floor on the subsea template and extend to the TLP. The risers must be maintained constantly in tension to avoid the risers collapsing from their own weight, despite movement of the TLP due to surface movement and weather extremes.

In the past, active hydropneumatic systems have been used to maintain a tension on the risers in TLP systems. Such use is described in a paper entitled "Conoco TLP Riser Tensioning Systems" authored by M. H. Frayne and F. L. Hettinger. Tensioners disclosed in this reference incorporate hydraulic actuators which stroke up and down in response to TLP movements to apply a relatively constant tension to each riser. This system has several disadvantages. It is an active system which requires continuous supply of high pressure fluids for operation. Thus, if a malfunction occurs which eliminates the supply of this high pressure fluid, the system can fail. Further, a sophisticated and expensive control system must be provided which maintains the desired pressure in the system. Therefore, a need exists for an improved tensioner system which avoids these disadvantages.

SUMMARY OF THE INVENTION

In accordance with one aspect of the present invention, a riser tensioner is provided for use in maintaining tension on a marine riser from a tension leg platform. The tension leg platform moves relative to the marine riser. The riser tensioner includes an elastomeric assembly interconnecting the tension leg platform and marine riser to maintain tension in the marine riser as the tension leg platform moves relative to the marine riser.

In accordance with another aspect of the present invention, the elastomeric assembly includes at least one first plate assembly operatively secured to the tension leg platform and a second plate assembly operatively secured to the riser. An elastomeric pad assembly is bonded between the first and second plate assemblies to be put in shear to tension the riser. The elastomeric pad assembly can include a plurality of elastomeric pads separated by rigid plates. The plate assemblies of two elastomeric assemblies can be connected to increase the travel of the riser relative to the tension leg platform. In addition, elastomeric pad assemblies can be bonded on both sides of a plate assembly to increase tension forces.

In accordance with another aspect of the present invention, the elastomeric assembly includes an elastomeric element resiliently deformable in torsion about a torsion axis. A first torque arm is secured at one end of the elastomeric element and operatively secured to the marine riser at a point spaced from the torsion axis. A second torque arm is secured to the opposite end of the elastomeric element and is operatively secured to the tension leg platform at a point spaced from the torsion axis. The elastomeric element can comprise a plurality of elastomeric disks separated by and bonded to rigid interconnecting pieces. The tensioner can use paired elastomeric assemblies with a first torque arm of one elastomeric assembly being secured to the second torque arm of another elastomeric assembly by structure for adjusting the force exerted between the riser and tension leg platform. Further structure can be provided to insure equal torsional deflection of the paired elastomeric assemblies.

In accordance with yet another aspect of the present invention, the elastomeric assembly includes a cylinder having an opening at one end and a piston extending into the interior of the cylinder through the opening. The cylinder and piston are pivotally connected between the tension leg platform and marine riser. Structure defines a support surface on the piston and a support surface on the cylinder to support the elastomeric assembly therebetween. The elastomeric assembly includes a first piston ring slidable along the piston, a first cylinder ring slidable along the interior of the cylinder and a second piston ring slidable along the piston. An elastomeric cone is bonded between the first piston ring and the first cylinder ring and is formed of a series of elastomeric rings bonded together with rigid interconnecting rings, a similar elastomeric cone is bonded between the first cylinder ring and the second piston ring with the interior of the cones facing each other so that the elastomeric assembly maintains the riser in tension by shear of the elastomeric cones. In another embodiment, the cylinder and piston are eliminated and inverted elastomeric cones are mated to tension the marine riser.

BRIEF DESCRIPTION OF THE DRAWINGS

A more complete understanding of the invention can be had by referring to the following Detailed Description taken with the accompanying Drawing, wherein:

FIG. 2 is a side view of the first embodiment;

FIG. 3 is a top view of the first embodiment;

FIG. 5 illustrates an alternative construction of the second embodiment;

FIG. 6 is a side view of a third embodiment of the present invention having mating inverted elastomeric cones;

FIG. 7 is a top view of the third embodiment; and

FIG. 8 is a side view of a fourth embodiment of the present invention incorporating mating inverted elastomeric cones within a piston and cylinder environment.

DETAILED DESCRIPTION

Figure 1:
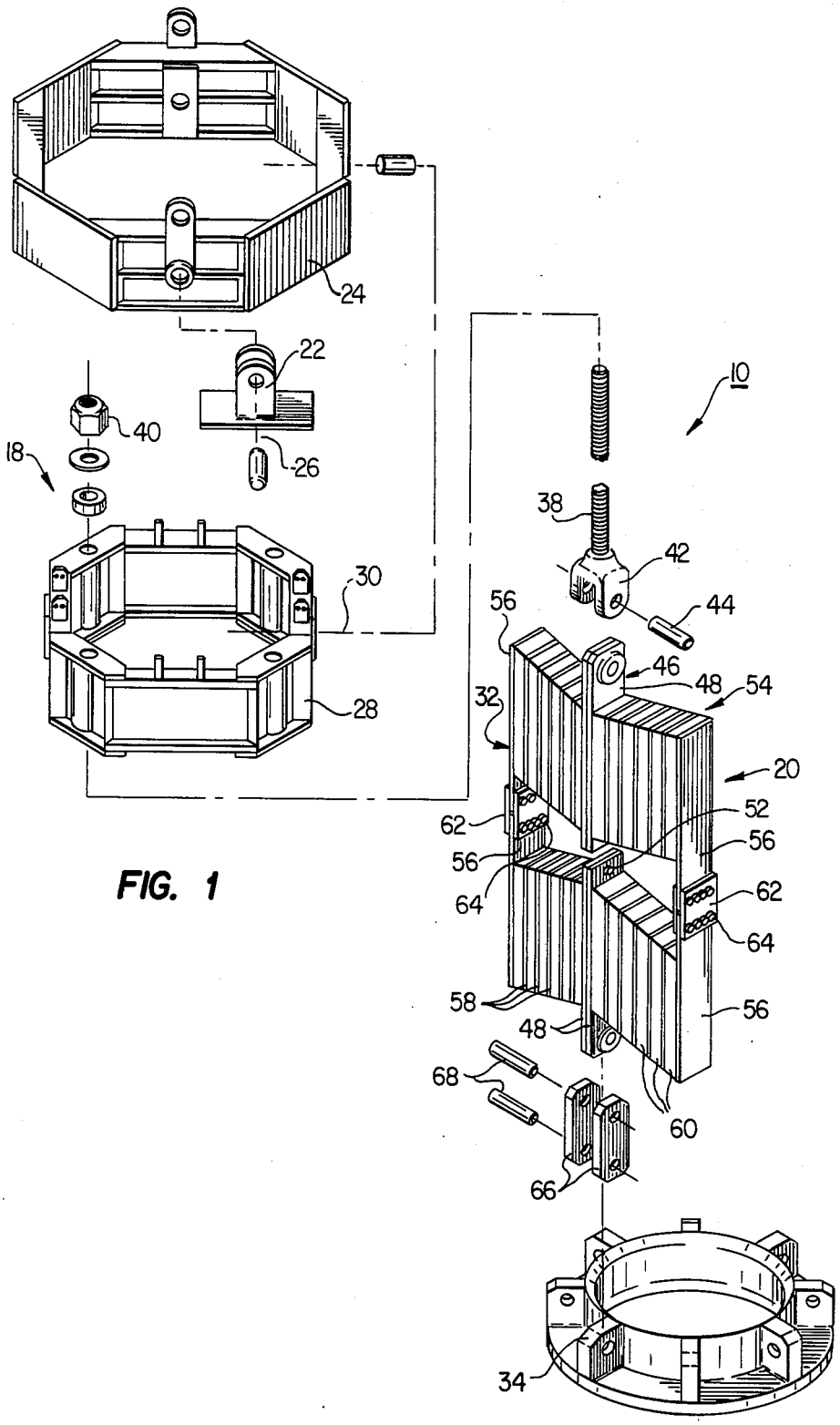
FIG. 1 is a perspective view of a first embodiment of the present invention for tensioning a marine riser on a tension leg platform.

Referring now to the drawings, wherein like reference numerals designate like or corresponding parts throughout several views, and in particular to FIGS. 1-3, there is illustrated a marine riser tensioner 10 forming a first embodiment of the present invention. The marine riser tensioner 10 is intended to maintain a minimum tension on a marine riser 12 as the tension leg platform 14 moves under the influence of wave motion, weather and other factors. The marine riser tensioner 10 is capable of maintaining a desired tension on the marine riser 12, typically in the range of 10-100 kips, despite vertical movement of the tension leg platform 14 relative to the marine riser 12 of perhaps as much as 6 feet in either direction from the normal or equilibrium level, and for a tilting of the platform 14 relative to the marine riser 12, up to an angle of as much as 10°.

The tensioner 10 is mounted on a deck 16 of the platform 14 with the majority of the tensioner extending below the deck through the hole in the deck through which the riser 12 passes. The tensioner 10 includes a gimbal assembly 18 which accommodates the pivoting of platform 14 relative to the riser 12 and an elastomeric assembly 20 which maintains the riser 12 in tension despite vertical movement of the platform 14 relative to the riser 12.

The gimbal assembly 18 includes upstanding arms 22 which are rigidly secured to the deck 16 and pivotally support a first gimbal ring 24 for pivotal motion about the horizontal axis 26. A second gimbal ring 28 is pivotally secured to the first gimbal ring for pivotal motion about a horizontal axis 30 which is perpendicular the horizontal axis 26. Rollers 31 on ring 28 bear against the riser, but allow vertical motion of platform 14 relative to the riser. Thus, the gimbal assembly is capable of accommodating any pivotal misalignment between the marine riser and platform.

The elastomeric assembly 20 is secured on the second gimbal ring 28. The elastomeric assembly 20 includes four identical elastomeric units 32 distributed at uniform radial positions about the riser. The units 32 are supported at their upper ends by the second gimbal ring and are secured to a base ring 34 at their lower end. A collar 36 is securely mounted on the riser 14. Collar 36 rests within the base ring 34 so that the riser is entirely supported on the platform 14 through the four elastomeric units 32.

Each elastomeric unit 32 includes a threaded rod 38 extending through the second gimbal ring 28. The threaded portion of rod 38 receives a nut 40 which rests on the top of the second gimbal ring 28. By rotating nut 40, the vertical position of rod 38 can be varied to deform the elastomeric elements in unit 32 to provide the desired tension to the marine riser 12. The lower end of threaded rod 38 has a clevis 42 which receives a cross pin 44. Cross pin 44 supports an upper plate assembly 46 formed by bolting together plates 48 with threaded fasteners 53. Plates 48 each form a part of an elastomeric section 54. Each section 54 has rigid plates exterior 48, 56 and interior plates 58 with elastomeric pads 60 bonded between the plates to form a unitary structure which is designed for supporting a force acting through the elastomeric section directed along the planes of bonding between the elastomeric pads 60 and the various plates 48, 56 and 58 in pad shear.

As can be seen in the figures, two upper elastomeric sections 54 are mounted side by side and attached by plates 48 to the threaded rod 38. A portion of the plate 56 of each of the upper elastomeric sections 54 depends from the rest of the section to connect with a mating pair of lower elastomeric sections 54 directly beneath. The plates 56 of the mating elastomeric sections are bolted together by connector plates 62 and fasteners 64. The plates 48 of the lower pair of elastomeric sections 54 are also bolted together with threaded fasteners 52. The base ring 34 has a link 66 supporting a cross pin 68 which receives the plates 48 of the lower elastomeric sections 54.

By use of four elastomeric units 32 distributed about the marine riser 12, vertical movement of the tension leg platform 14 relative to the riser is accommodated by deformation of the elastomeric pads 60 in pad shear. While any number of units 32 can be used, it is preferable to position the units so that the total force vector acting on the marine riser as a result of the units lies on the central axis of the riser. To set the desired tension on the marine riser, the elastomeric pads 60 are placed in pad shear by adjusting the nuts 40 to tension the marine riser at the equilibrium point of the motion of the tension leg platform 14 relative to the riser 12. The elastomeric assembly 20 will maintain sufficient tension on the marine riser as the platform 14 moves either direction around the equilibrium point relative to the riser by a suitable deformation of the elastomeric pads 60. Misalignment between the platform 14 and the riser 12 will be accommodated through the gimbal assembly 18.

The material forming the elastomeric pads 60 can be selected for the desired operating characteristics. It is contemplated that the elastomeric pads 60 can be made of synthetic and/or natural rubber materials. For example, in service where wide fluctuations in temperature is expected, a blended natural rubber might be preferable. The elastomeric assembly can be made with the relationship between force and deflection either linear or nonlinear, as desired.

Figure 4:
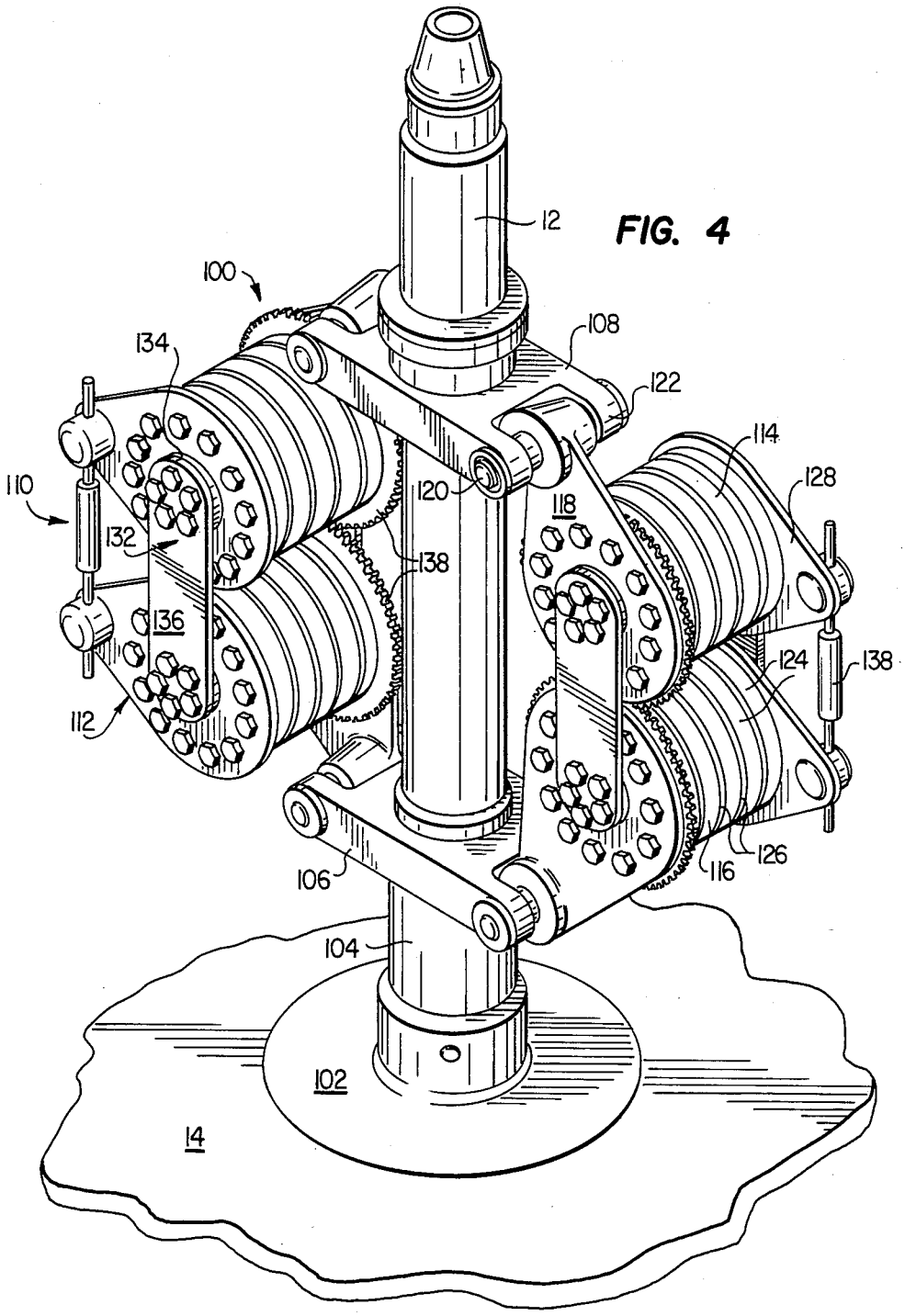
FIG. 4 is a perspective view of a second embodiment of the present invention which employs elastomeric elements in torsional shear.

With reference now to FIG. 4, a second embodiment of the present invention is illustrated which comprises a marine riser tensioner 100. The mariner riser tensioner 100 accomplishes the basic result of tensioner 10, but differs in placing elastomeric materials in torsional shear, rather than pad shear. A flex joint 102 is mounted on platform 14 and has a tube 104 through which riser 12 passes. The flex joint 102 accommodates the misalignment between the platform 14 and the riser 12.

A slip joint attachment 106 is rigidly secured to the tube 104. A tether attachment 108 is, in turn, rigidly secured on the riser 12 above the tube 104. The elastomeric assembly 110 is mounted between the attachments 106 and 108 to tension the riser and maintain the riser in tension despite vertical movement of the platform 14 relative to the riser 12.

The elastomeric assembly includes a pair of elastomeric units 112. Each elastomeric unit 112 includes an upper elastomeric cylinder 114 and a lower elastomeric cylinder 116. The upper elastomeric cylinder 114 has a torque arm 118 secured to pin 120 supported at a clevis 122 on the tether joint attachment 108. Torque arm 118 is bonded to one end of a series of alternating elastomeric disks 124 and rigid interconnecting disks 126. A torque arm 128 is bonded at the other end of the series of disks 124 and 126. The upper elastomeric cylinder 114 defines a torsion axis 130. It can seen that deflection of torque arm 118 relative to torque arm 128 about axis 130 will deform the elastomeric disks 124 in torsional shear.

The lower elastomeric cylinder 116 is of substantially identical construction as the upper elastomeric cylinder 114. A link 132 connects the cylinders 114 and 116. Link 132 includes tubes 134 which pass through the center of each of the cylinders, and each tube is mounted to the cylinders for free rotation about the torsion axis. Cross bars 136 connect the ends of the tubes 134 together to maintain the cylinders 114 and 116 side by side with their torsion axes parallel. Mating gear rings 138 form part of the torque arm 18 of each cylinder. The ends of the torque arms 128 of the cylinders are interconnected at a position spaced from their torsion axis by an adjustable length rod 138.

By adjusting the length of rod 138 between the attachment points to the torque arms 128, a predetermined torsional shear force can be created in the elastomeric disks 124 of cylinder 114 and 116 which tensions the marine riser 12. As the platform 14 moves relative to the riser 12, the elastomeric disks 124 will deform in torsional shear about the torsion axes 130 of the cylinders 114 and 116 to accommodate the motion while maintaining a tension on the marineriser. The use of mating gear rings 138 assures that the pivotal motion of the torque arm 118 of each cylinder 114 and 116 will be equal for a given displacement of the platform 14 relative to the riser 12. This will equalize fatigue in the elastomeric disks 124 to prevent one cylinder from wearing prematurely.

Two units 112 are employed, and positioned on opposite sides of riser 12 to ensure that the net force exerted by units 112 lies along the center axis of riser 12.

FIG. 5 illustrates a modification of the marine riser tensioner 100 illustrated in FIG. 4. In this modification, the torque arms 118 have elastomeric disks 124 bonded on both sides to form a double upper elastomeric cylinder 142. A similar double lower elastomeric cylinder is formed to cooperate with the cylinder 142. In addition, two additional elastomeric units 112 are mounted between the riser and platform at a 90° angle from the prior used elastomeric units. This modification will support a greater tension than tensioner 100 for very little increase in size. Other configurations can be contemplated to adapt the principles of the tensioner 100 to a particular application.

FIGS. 6 and 7 illustrate a third embodiment of the present invention formed by a marine riser tensioner 200. The marine riser 12 passes upward through the deck 16 of platform 14 through a gimbal assembly 202. A plate 204 is rigidly secured to the riser above the deck 16. Four elastomeric units 206 act between the plate 204 and the deck 16 to tension the marine riser and permit vertical movement of the platform 14 relative to the riser 12.

Each of the elastomeric units 206 is formed of stacked elastomeric cones 208. The cones are paired off so that the open ends of two adjacent cones face each other, while the cones on either side of the mated pair open the opposite direction. The mated pair of cones are connected at their radially outer edges by outer rings 210. The radially inner portion of the cones are bonded to inner rings 212. The inner rings 212 of adjacent nonmated cones are secured together to form the stack, with the uppermost inner ring 212 fitted to a pin 214 depending from plate 204 and the lowermost inner ring 212 mated to an upstanding pin 216 on the deck 16.

Each of the elastomeric cones 208 is formed of an assembly of elastomeric rings 218–228 which have an ever increasing radius from inner ring 212 and ever decreasing height from inner ring 212. An intermediate rigid ring 230–238 is bonded between adjacent elastomeric rings to form the complete elastomeric cone. The elastomeric cones thus taper in height from the inner ring 212 to the outer ring 210 as seen in FIGS. 6 and 7.

The marine riser 12 can be tensioned by setting the distance between the plate 204 and deck 16 between the platform 14 and riser 12 so that the elastomeric rings 218–228 are in elastomeric shear to tension the riser 12 at the equilibrium point. Vertical movement of the platform 14 will vary the deformation of the elastomeric rings while maintaining tension on the riser 12.

With reference to FIG. 8, a fourth embodiment of the present invention is illustrated which comprises a marine riser tensioner 300. Brackets 302 are rigidly secured to the tension leg platform 14. A collar 304 is rigidly secured to the riser 12. A cylinder 306 is pivotally secured to each of the brackets 302 by a pin 308. A piston 310 is provided corresponding to each of the cylinders 306 with the piston 310 pivoted to the collar 304 by a pin 312. A length of the piston 310 enters the interior of the cylinder 306 through an opening 314 in the end of cylinder 306 opposite the pivot point with pin 308. The end of the piston disposed within the cylinder has a cap 316 defining a first support or end surface 318. A second support or end surface 320 is defined on the interior of the end of the cylinder 306 about the opening 314.

An elastomeric assembly 322 is provided within the cylinder 306 which acts between the end surfaces 318 and 320 to tension the marine riser 12. The elastomeric assembly 322 is comprised of a series of mated elastomeric cone assemblies 324 having elements 208, 210 and 212 as discussed previously. In addition, the inner surface of inner rings 212 and the outer surface of outer rings 210 are adapted for sliding motion on the exterior of the piston 310 and the interior of the cylinder 306, respectively. Thus, as the platform 14 moves relative to the riser 12, the first and second end surfaces 318 and 320 move either toward or away from each other, either compressing or permitting expansion of the elastomeric cone assemblies 324 within the cylinder 306 with the rings 210 and 212 sliding along the piston and cylinder as required. Any number of mated elastomeric cone assemblies 324 can be provided along the length of the piston 310 to provide the desired tension in the marine riser. Preferably, a number of cooperating cylinders 306 and pistons 310 are mounted between the platform 14 and riser 12 to provide a net tension force vector along the centerline of the riser 12.

While several embodiments of the invention have been illustrated in the accompanying Drawings and described in the foregoing Detailed Description, it will understood that the invention is not limited to the embodiments disclosed, but is capable of numerous rearrangements, modifications and substitutions of parts and elements without departing from the spirit of the invention.

I claim:

1. A riser tensioner for use in maintaining a tension on a marine riser from a tension leg platform, the tension leg platform moving relative to the marine riser, comprising:

at least one elastomeric cylinder having a first torque arm and a second torque arm, an elastomeric disk bonded between said torque arms for deformation in torsional shear about a torsion axis;

means for operatively securing said first torque arm to said tension leg platform at a position spaced from the torsion axis; and means for operatively connecting said second torque arm to said marine riser spaced from the torsion axis, torsional shear in said elastomeric disk tensioning the marine riser.

2. The riser tensioner of claim 1 wherein a plurality of elastomeric disks are provided in the elastomeric cylinder, a first of said disks being bonded to said first torque arm and a second of said disks being bonded to said second torque arm, rigid intermediate disks being bonded between adjacent elastomeric disks.

3. The riser tensioner of claim 1 further having a second elastomeric cylinder and means for securing said first and second elastomeric cylinders with the torsion axes parallel, and means for connecting a torque arm of each cylinder to a torque arm of the other cylinder.

4. The riser tensioner of claim 3 wherein said means for connecting torque arms on said cylinders is adjustable to set in a predetermined torsional shear in the elastomeric disks to tension the marine riser.

5. The riser tensioner of claim 3 further having means for insuring that the rotation of each of the cylinders about the torsion axis is uniform.

* * * * *